United States Patent [19]

Woods et al.

[11] 3,984,073

[45] Oct. 5, 1976

[54] ANTENNA APPARATUS FOR VEHICLE TRACK RAIL SIGNALS

[75] Inventors: David H. Woods, Pittsburgh; Robert H. Perry, Canonsburg, both of Pa.

[73] Assignee: Westinghouse Electric Corporation, Pittsburgh, Pa.

[22] Filed: Oct. 17, 1974

[21] Appl. No.: 515,747

[52] U.S. Cl. ..... 246/34 R; 246/167 M

[51] Int. Cl.[2] ..... B61L 3/22

[58] Field of Search..... 246/34 R, 34 CT, 36, 246/40, 63 R, 63 A, 63 C, 167 M, 249; 179/82

[56] References Cited

UNITED STATES PATENTS 3,746,857 7/1973 Hoyler ..... 246/36

R27,472 9/1972 Thorne-Booth ..... 246/34 CT

*Primary Examiner*—Trygve M. Blix
*Assistant Examiner*—Reinhard J. Eisenzopf
*Attorney, Agent, or Firm*—R. G. Brodahl

[57] ABSTRACT

An antenna apparatus is disclosed for improved coupling of audio signals in relation to the vehicle track of a transit system operative with steel rails and providing a reduced cost for the associated hardware and lower crosstalk with adjacent signal blocks and track rails.

9 Claims, 9 Drawing Figures

ANTENNA APPARATUS FOR VEHICLE TRACK RAIL SIGNALS

CROSS-REFFERENCE TO RELATED APPLICATION

The present application is related to a concurrently filed patent application Ser. No. 515,746 filed Oct. 17, 1974 by R. S. Rhoton et al. and entitled "Antenna Apparatus for Vehicle Track Rail Systems," and assigned to the same assignee as the present application.

BACKGROUND OF THE INVENTION

It is known in the prior art to couple speed code signals and vehicle occupancy detection signals into running track rails for the movement control of transit vehicles by direct injection electrical connection directly into the running rails or into a low impedance shunt boundary connection between the rails and by magnetic coupling from an air core loop into one or more of the track rails such as described in U.S. Pat. Reissue Nos. 27,472 of G. M. Thorne-Booth and 3,746,857 of R. C. Hoyler et al.

The magnetic coupling loop has a relatively large area resulting in stray magnetic fields and the problem of signal cross-talk with parallel track rails.

SUMMARY OF THE INVENTION

An antenna apparatus is provided for magnetically coupling audio signals into the running rails of a steel track rail for providing desired communication with a transit or like vehicle. The antenna apparatus includes side plate members having a reduced area and making use of the rail itself for a portion of the magnetic flux path. Coupling into the rail can be varied in relation to different signal block impedance conditions by varying either the number of turns of signal conductor operative with one or more of the side plate members or by changing the effective length of the antenna apparatus in one of the signal blocks.

DESCRIPTION OF THE PREFERRED EMBODIMENT

Figure 1:
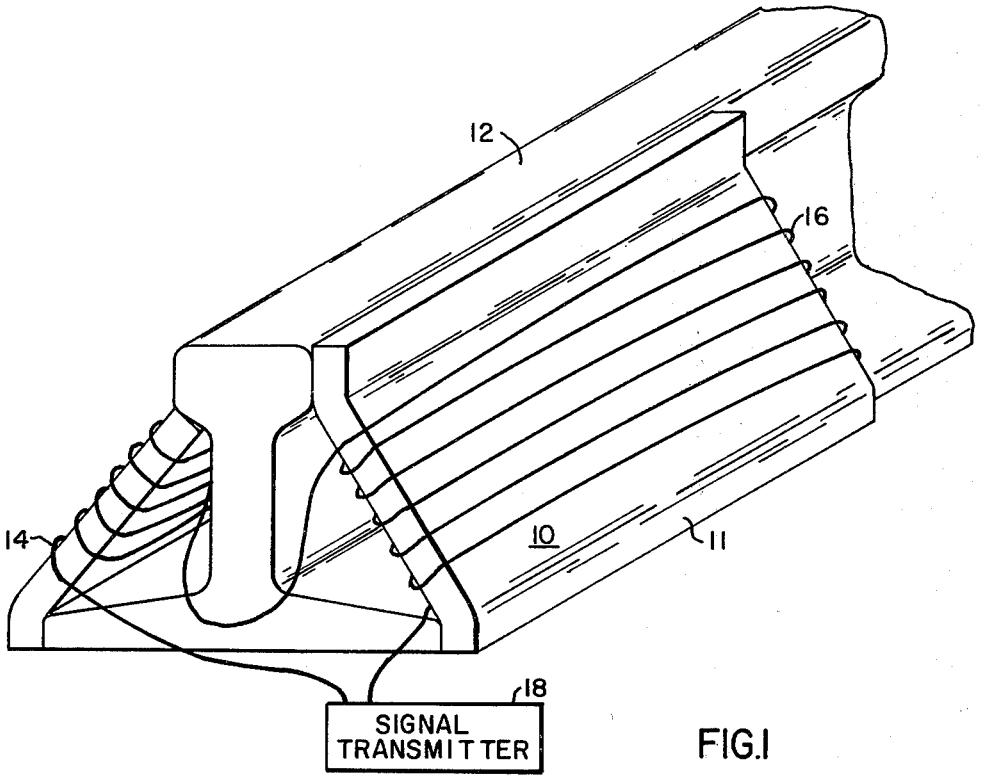
FIG. 1 is a perspective showing of one embodiment of the antenna apparatus of the present invention.

In FIG. 1 there is shown a perspective illustration of one embodiment of the present antenna apparatus 10 including a plate member 11 partially surrounding a track rail 12 and provided with windings 14 and 16 as illustrated for the purpose of injecting a signal current in the rail 12 from the signal transmitter 18. The rail 12 forms part of the magnetic circuit in an effort to increase the coupling efficiency of the signal current into the rail 12 and to reduce cross-talk stray magnetic field coupling into adjacent and parallel track rails. In effect, a transformer coupling air gap is provided between the plate 11 and the head of the rail 12.

By positioning the two side plate members against the respective sides of the rail 12 the magnetic field passes through the plates and the bottom of the rail or through the bottom plate member and across the top of the rail head. An EMF signal is generated in the rail 12.

Figure 2:
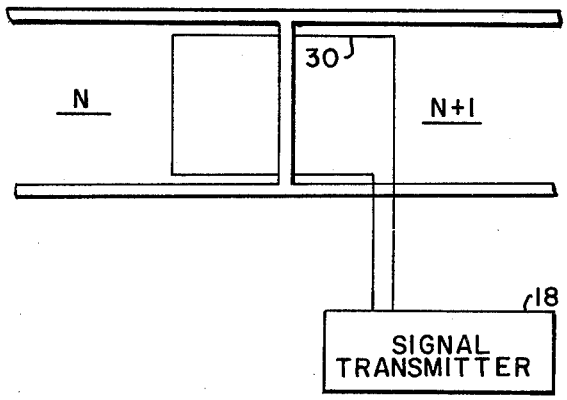
FIG.2 PRIOR ART
FIG. 2 illustrates a typical prior art loop antenna apparatus.

In FIG. 2 there is shown the prior art loop antenna 30 for inductively injecting a signal voltage in each of track circuit signal blocks N and N+1.

Figure 3:
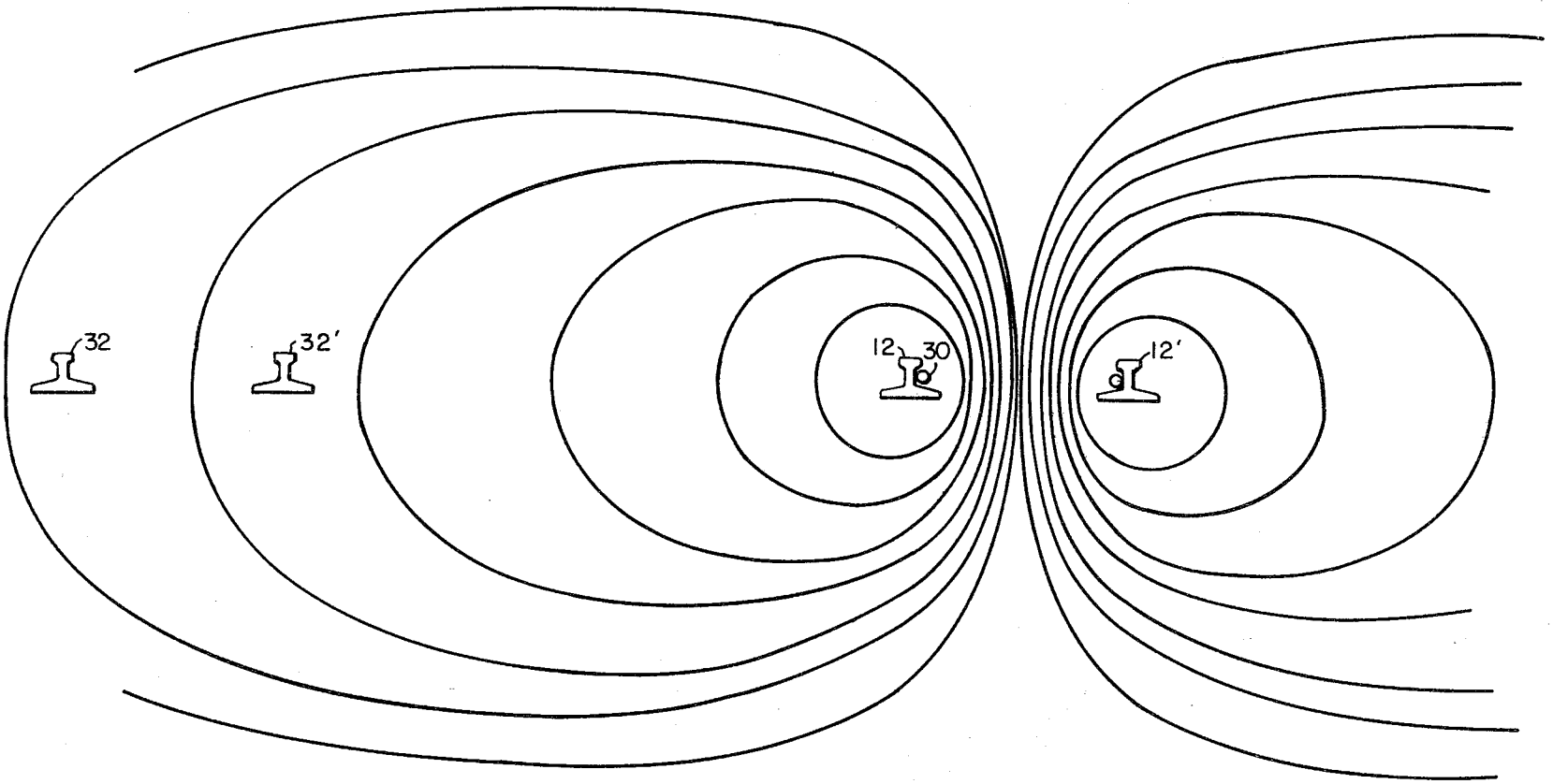
FIG. 3 PRIOR ART
FIG. 3 illustrates the field flux provided by the prior art loop antenna apparatus.

As shown in FIG. 3 the magnetic field flux resulting from the loop antenna 30 shown positioned adjacent the track rails 12 and 12' of a vehicle track would provide a magnetic flux field as indicated and which would couple the adjcent vehicle track rails 32 and 32'. For example, the track rails 12 and 12' could be provided for vehicle traffic moving in a first direction and the track rails 32 and 32' could be provided for vehicle traffic moving in an opposite direction. The magnetic field flux coupling illustrated in FIG. 3 would result in the injection of signal current levels in the track rails 32 and 32' such that a cross-talk effect might be provided and the speed code signals intended for the track rails 12 and 12' may not be desired for the track rails 32 and 32'.

Figure 4:
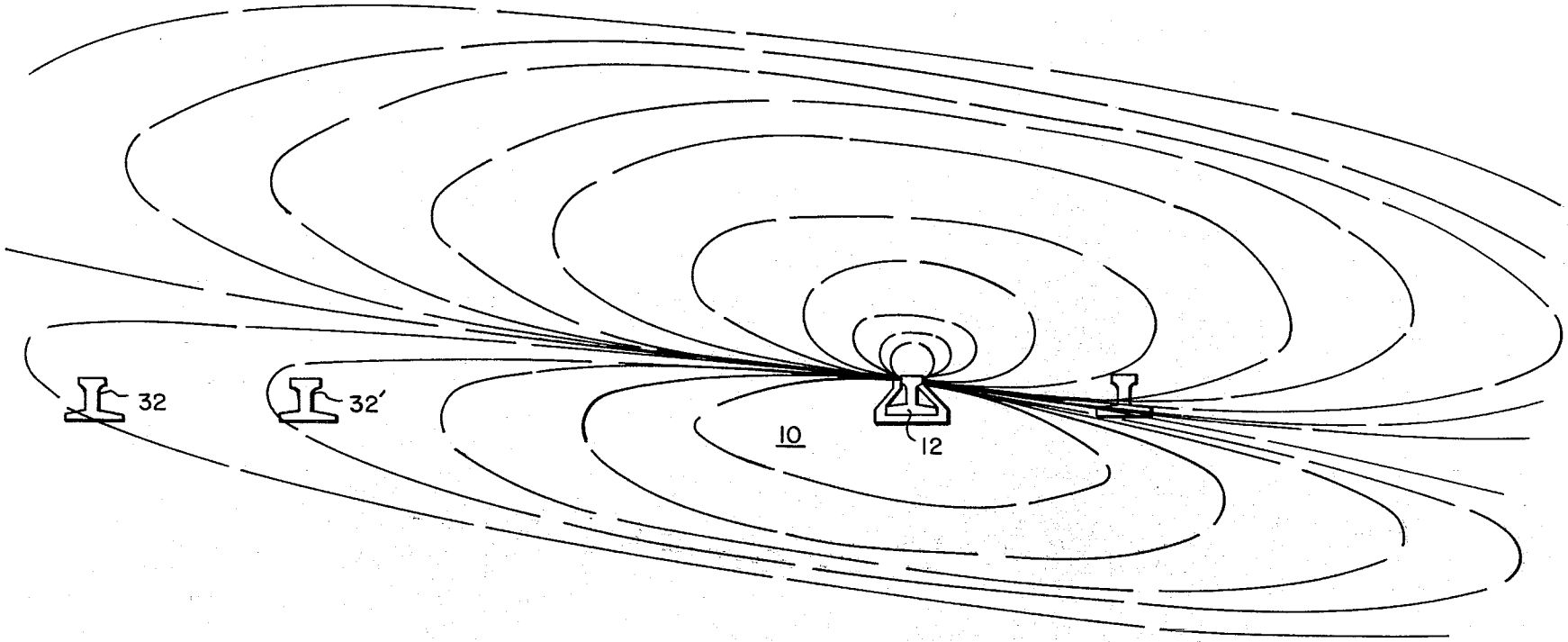
FIG. 4 illustrates the stray field flux provided by the antenna apparatus of the present invention.

In FIG. 4 the stray magnetic field flux provided by the antenna apparatus 10 of the present invention is illustrated such that the plane of the track rails 32 and 32' is substantially in a null of the magnetic field provided by the antenna apparatus 10 shown operative with track rail 12 and this results in little or no signal cross-talk with the parallel track rails 32 and 32'.

Figure 5:
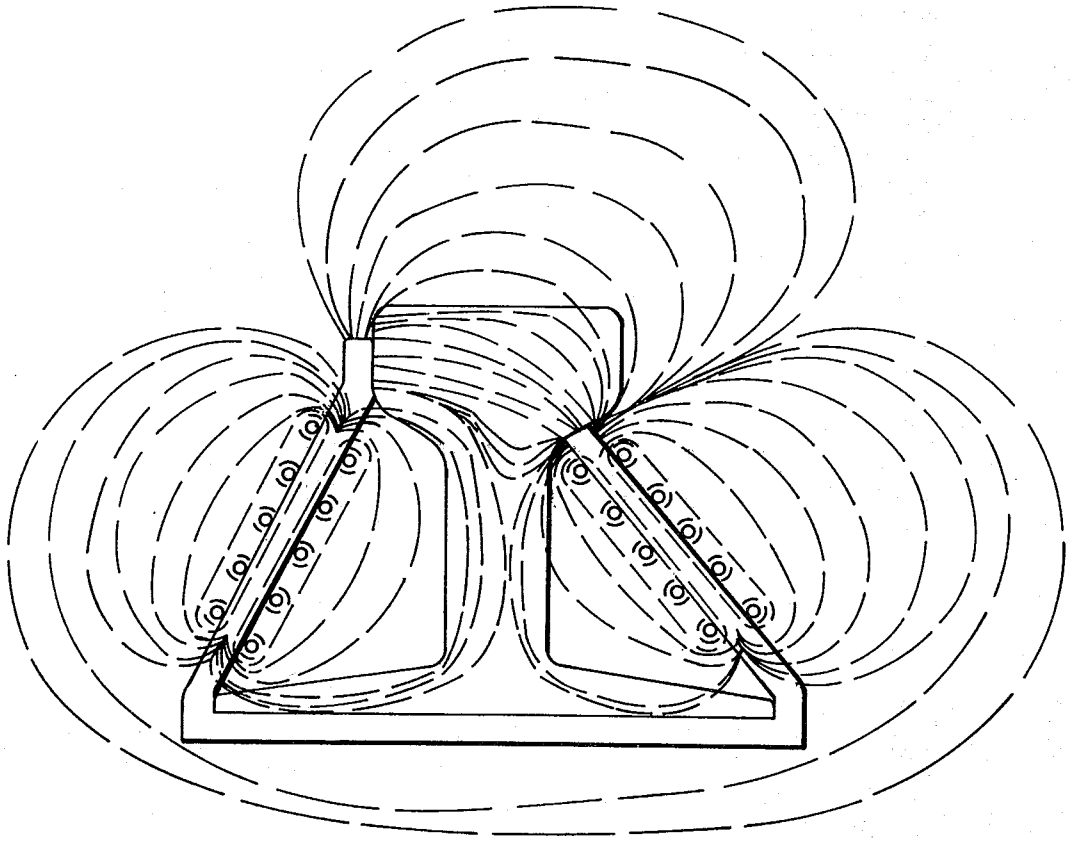
FIG. 5 illustrates the field flux provided by the present antenna apparatus for coupling signal current into a track rail.

The present antenna apparatus utilizes a U-shaped plate member for concentrating the provided magnetic field around the track rail 12 and the stray flux going out into the surrounding air is arranged as shown in FIG. 4 with very little flux linking the parallel track rails 32 and 32'. The air gap is substantially reduced and the flux is shown to be very concentrated at the top of the rail 12 as shown in FIG. 5. The bottom plate extends underneath each track rail as shown in FIG. 5 and if desired suitable cutout portions can be included to provide openings for the well known rail support ties since the antenna apparatus 10 may be in the order of three meters or approximately ten feet in length.

Figure 6:
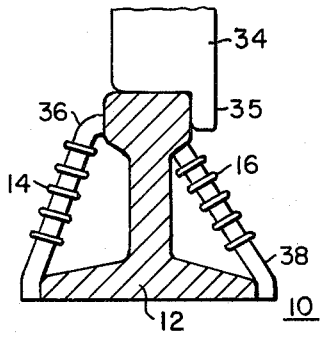
FIG. 6 shows an end view of a track rail including the antenna apparatus of the present invention.

The rail 12 already has a steel base so if desired the base of the rail 12 can be used as a portion of the magnetic flux path with side plates as shown in FIG. 6 concentrating the magnetic field flux resulting from the windings 14 and 16 of the antenna apparatus 10. The vehicle wheel 34 has to run on the top of the rail 12 and physical clearance space for the wheel flange 35 must be provided. Thusly, one of the side plates 36 can extend up the side of the rail head where no flange room is required and the other side plate 38 can be positioned up under a lower portion of the rail head as required to permit satisfactory physical passage of the wheel flange 35.

The flux resulting from the present antenna apparatus should encircle the entire or whole cross-section of the rail as much as is practical for optimum signal coupling into the rail 12. Otherwise eddy currents can waste signal power and the resulting voltage source distribution along the rail is somewhat disturbed. By having the flux encompass as much of the rail 12 as is practical, this will minimize the waste of signal power through induced voltage sources in undesired eddy currents.

The reasonable length of the antenna apparatus in accordance with the present invention will be between 1 meter and 3 meters for signal frequencies in the order of 1000 Hertz such as here involved and this results in a long and low distributed EMF signal along the length of the rail 12. A typical railroad rail made of steel tends to be rather lossy at signalling frequencies and eddy currents become a problem in relation to the typical rail. The length of the antenna and the low flux density is beneficial to reduce undesired eddy currents in the rail and an evenly distributed antenna over a relatively large area of the rail is desired.

A typical prior art loop antenna 30 such as shown in FIG. 2 may have a length of about three meters and is a rather efficient antenna with low eddy current losses because the flux density in the rail at any point is relatively low and is evenly distributed along the rail. A small flux differential is going through any point in the rail.

Figure 7:
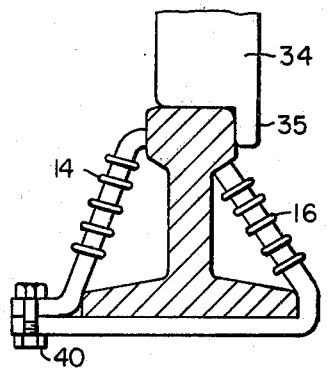
FIG. 7 shows an end view of a track rail including a modification of the antenna apparatus in accordance with the present invention.

Another embodiment of the antenna apparatus is shown in FIG. 7. The plate surrounding the rail can be made into two shaped plates as illustrated and connected together by sliding one piece under the rail 12 and securely fastening the plates by a suitable fastener 40. The desire is to minimize eddy current losses in the rail with a minimum signal cross-talk between parallel tracks and provide the most efficient method of signal injection into the rails, with a capability of balancing the signals in the respective signal blocks adjacent to a low impedance boundary member.

Figure 8:
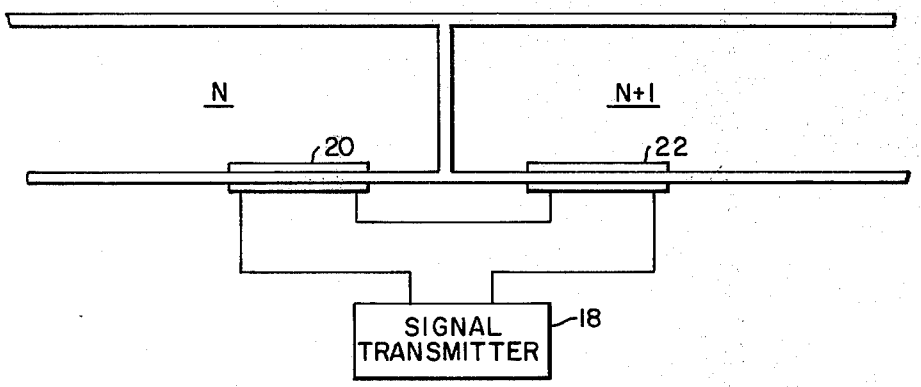
FIG. 8 illustrates the practical operation of the present antenna apparatus in relation to two signal blocks adjacent to a low impedance boundary member connected between the rails of a vehicle track.

As shown in FIG. 8, a first antenna apparatus 20 and a second antenna apparatus 22 can be connected in series with the signal transmitter 18 such that a signal block N operative with the antenna apparatus 20 and a signal block N+1 operative with the antenna apparatus 22 would thereby receive injected signal levels of substantially the same magnitude in each of the respective signal blocks N and N+1.

Figure 9:
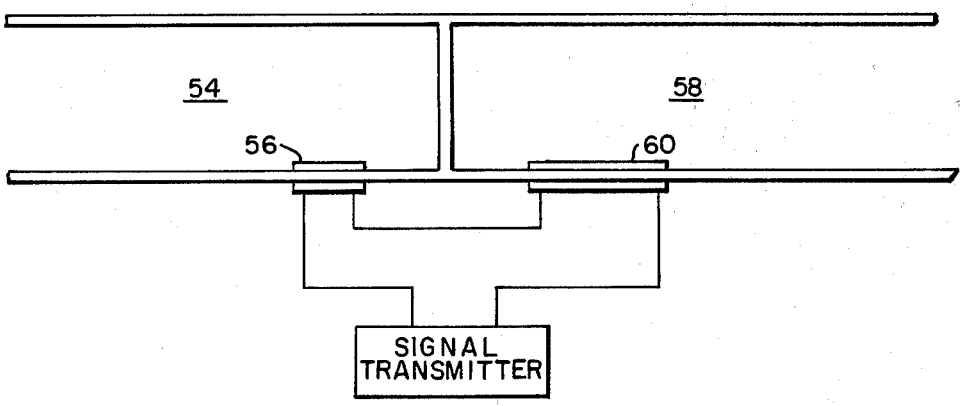
FIG. 9 illustrates the practical operation of the present antenna apparatus in relation to two signal blocks having respectively different input impedance characteristics.

In FIG. 9 there is illustrated a practical application of the present antenna apparatus, whereby a signal block 54 of 150 meters length is operative with a signal antenna 56 and a signal block 58 of 300 meters length is operative with a signal antenna 60. If the input impedance of signal block 54 is approximately one half the input impedance of signal block 58, then substantially balanced signal levels should be provided with the antenna 56 being one half the length of the antenna 60, assuming the number of winding turns is the same for each antenna.

An antenna apparatus in accordance with the present invention as shown in FIG. 6 was actually constructed, with the two side plates being approximately 0.6 meter long and each wound with a coil of 75 turns made of 18 AWG isulated wire. The antenna apparatus was operative with a signal block of 225 meters length and having a ballast shunt resistance of 12 ohms per 300 meters. A signal current level of 50 milliamp rms was induced in the rail at a frequency of 1000 Hertz. This represented a 0.34 Volt rms driving voltage in the rail. It should be understood by persons skilled in this art that an increase in antenna length would increase the signal current level in the rail, if desired, for the same number of turns and the same coil current level.

What is claimed is:

1. In an antenna apparatus for providing a signal current in at least one track rail of a track circuit lying in a plane and including a plurality of signal blocks for the control of a vehicle operative with said track circuit the combination of means operative with each of adjacent signal blocks for inducing said signal current in said one track rail, and means operative with said signal current inducing means for establishing a magnetic field flux around at least a portion of said one track rail, with said field flux being oriented substantially parallel to said plane such that said plane is in a null of said magnetic field flux.

2. The antenna apparatus of claim 1, with said magnetic field flux establishing means including side plate members conductive to said magnetic field flux and positioned against the respective sides of said one track rail to increase the concentration of said magnetic field flux in said one track rail.

3. The antenna apparatus of claim 1, with said at least one track rail being in a first track circuit operative adjacent to a second track circuit lying in said plane, said signal current inducing means providing greater than a predetermined minimum level of signal current in said first track circuit, and said magnetic field flux establishing means being operative such that any signal current induced in said second track circuit by said magnetic field flux is less than said predetermined minimum level.

4. The antenna apparatus of claim 1, with said signal current inducing means including a first antenna member operative with a first of said adjacent signal blocks and a second antenna member operative with a second of said adjacent signal blocks, and with the length of said first antenna member being selected in accordance with the input impedance of said first signal block and the length of said second antenna member being selected in accordance with the input impedance of said second signal block.

5. In antenna apparatus for providing at least a minimum signal current level in each of adjacent signal blocks of a track circuit lying in a plane and operative to control a vehicle moving along said track circuit, the combination of first means operative with one of said adjacent signal blocks for providing at least said minimum signal current level in said one signal block and including a first magnetic flus coupling member for establishing a first magnetic field flux in relation to said one signal block and substantially parallel to said plane, and second means operative with another of said adjacent signal blocks for providing at least said minimum signal current level in said another signal block and including a second magnetic flux coupling member for establishing a second magnetic field flux in relation to said another signal block and substantially parallel to said plane.

6. The antenna apparatus of claim 5, with said one signal block including a first track rail having a first head and said firt magnetic flux coupling member being positioned around substantially all of said first track rail other than said first head, and with said another signal block including a second track rail having a second head and said second magnetic flux coupling member being positioned around substantially all of said second track rail other than said second head.

7. The antenna apparatus of claim 5, with each of said adjacent signal blocks including a track rail, and with each of said first and second magnetic flux coupling members including side plates conductive to magnetic field flux and positioned against the side of the respective track rails of said one and another signal blocks.

8. The antenna apparatus of claim 5, with said track circuit being positioned adjacent to at least one additional track circuit, and with each of said first and second magnetic flux coupling members being operative to provide less than said minimum signal current level in said one additional track circuit.

9. The antenna apparatus of claim 5, with the magnetic flux coupling between said first means and said one signal block being determined in accordance with the input impedance of said one signal block and the magnetic flux coupling between said second means and said another signal block being determined in accordance with the input impedance of said another signal block.

* * * * *